US005934574A

United States Patent [19]

van der Steur

[11] Patent Number: 5,934,574

[45] Date of Patent: *Aug. 10, 1999

[54] ROTARY ATOMIZER

[76] Inventor: Gunnar van der Steur, 3415 McCommons Rd., Churchville, Md. 21078

[ * ] Notice: This patent issued on a continued prosecution application filed under 37 CFR 1.53(d), and is subject to the twenty year patent term provisions of 35 U.S.C. 154(a)(2).

[21] Appl. No.: 08/567,704

[22] Filed: Dec. 5, 1995

[51] Int. Cl.[6] ..... B05B 5/00

[52] U.S. Cl. ..... 239/690.1; 239/700; 239/504

[58] Field of Search ..... 239/690, 690.1, 239/700–3, 708, 240, 237, 704–7, 504, 509; 118/621, 629

[56] References Cited

U.S. PATENT DOCUMENTS

| | | | |
|---|---|---|---|
| 2,159,400 | 5/1939 | Preston | 237/222.1 |
| 2,220,275 | 11/1940 | Preston | 275/222.1 |
| 2,893,894 | 7/1959 | Ransburg | 117/93 |
| 4,148,932 | 4/1979 | Tada et al. | 427/31 |
| 4,165,022 | 8/1979 | Bentley et al. | 239/704 |
| 4,214,708 | 7/1980 | Lacchia | 239/224 |
| 4,275,838 | 6/1981 | Fangmeyer | 239/223 |
| 4,405,086 | 9/1983 | Vetter | 239/224 |
| 4,518,119 | 5/1985 | Vetter | 239/223 |
| 4,576,827 | 3/1986 | Hastings et al. | 427/27 |
| 4,605,168 | 8/1986 | Tachi et al. | 239/112 |
| 4,643,357 | 2/1987 | Culbertson et al. | 239/112 |
| 4,744,513 | 5/1988 | Meisner et al. | 239/3 |
| 4,776,520 | 10/1988 | Merritt | 239/700 |
| 4,784,332 | 11/1988 | Takeuchi et al. | 239/703 |
| 4,928,883 | 5/1990 | Weinstein | 239/223 |
| 4,936,507 | 6/1990 | Weinstein | 239/71 |
| 4,943,005 | 7/1990 | Weinstein | 239/223 |
| 5,011,085 | 4/1991 | Lööf | 239/690 |
| 5,039,019 | 8/1991 | Weinstein et al. | 239/691 |
| 5,078,321 | 1/1992 | Davis et al. | 239/224 |
| 5,544,813 | 8/1996 | Giles et al. | 239/71 |
| 5,582,875 | 12/1996 | Ryosuke | 427/475 |

FOREIGN PATENT DOCUMENTS

| | | | |
|---|---|---|---|
| 0 032 391 | 7/1981 | European Pat. Off. . | |
| 0 104 394 | 4/1984 | European Pat. Off. . | |
| 1263775 | 7/1957 | France . | |
| 1363681 | 7/1963 | France . | |
| 37 16 692 C2 | 2/1995 | Germany . | |
| 59-42032 | 3/1984 | Japan . | |
| 846181 | 8/1960 | United Kingdom | 69/16 B |
| 1 515 511 | 6/1978 | United Kingdom . | |

*Primary Examiner*—Andres Kashnikow
*Assistant Examiner*—Lisa Ann Douglas
*Attorney, Agent, or Firm*—Foley & Lardner

[57] ABSTRACT

A sprayer, such as an electrostatic rotary bell-shaped sprayer is made from a material comprising carbon fiber, teflon and polypropylene. An exemplary material comprises about 30% carbon fiber, about 5% teflon, and about 65% polypropylene. When used for electrostatic spraying, the sprayer provides a mist containing an electrical charge equal to at least 20% of the charge applied to the sprayer. For example, when 100,000 volts are applied to the sprayer, the downstream mist contains a charge of at least 20,000 volts. The sprayer can also include a plurality of pits arranged near its outer edge in an offset matrix pattern producing therebetween two sets of intersecting surface lines. The sprayer can further include a deflection part with a pointed rear center section positioned opposite an opening in a base part. A plurality of axial passages positioned around the pointed section and extending toward a front surface of the deflection part allow for the passage of cleaning fluid therethrough. The device according to the invention provides better atomization and better adhesion of paint to a grounded article such that less paint is required than is required with conventional devices, and further provides ease of cleaning and increased durability.

36 Claims, 3 Drawing Sheets

ROTARY ATOMIZER

BACKGROUND OF THE INVENTION

The invention is directed to a spraying apparatus. For example, the invention is directed to an atomizing sprayer which is used to atomize a liquid into a mist for application to an article. Such a sprayer can be used, for example, to atomize paint to be applied to an article. The sprayer can operate electrostatically, wherein there is a difference in electrical potential between the liquid and the article. For example, a charge can be applied to the paint and the article can be grounded, such that the atomized liquid is attracted through electrical forces to the article.

One such conventional sprayer is a rotary atomizer which rotates at a high rate of speed around a central axis in order to atomize a liquid into a mist. A source of electrical power can be connected to such a rotary atomizer in order to charge the liquid as it flows through the rotary atomizer such that the mist produced by the rotary atomizer will be electrically attracted to the article to be coated. For example, when painting an automobile, conventional rotary atomizers are provided with a charge of a 100,000 volts and the car to be painted is grounded. As paint passes through such an electrically charged rotary atomizer, the resulting mist picks up the charge and is therefore attracted to the automobile.

Conventional rotary atomizers are bell-shaped and made from materials such as aluminum. Some versions of these conventional atomizers are provided with a plurality of channels or grooves near an outer edge of the atomizer. These grooves are intended to separate the paint into uniform streams within the grooves. After passing through these grooves, the paint is atomized at a point beyond an outer edge of the atomizer. Other conventional atomizers have intersecting grooves which are used to mix multi-component paint prior to atomization of the paint.

These conventional atomizers have many drawbacks. For example, when a 100,000 volt charge is applied to the atomizer, and therefore to the liquid flowing therethrough, the charge of the mist created by the atomizer is significantly less than 100,000 volts at a point where the mist makes contact with the article. For example, in a conventional atomizer spaced a conventional distance of 18 inches from an automobile with a charge of 100,000 volts applied to the atomizer, the charge on the resulting mist as it reaches the automobile is typically between 16,000 and 18,000 volts. Thus, a significant portion of the 100,000 volts applied to the paint via the atomizer is dissipated. This charge dissipation is a significant drawback, since the charge on the atomized mist is directly proportional to the amount of attraction of the mist to the grounded article. If an apparatus can provide the mist with a higher charge, a greater percentage of the mist will adhere to the article and less paint will be required in order to adequately cover the article.

Another drawback of conventional aluminum rotary atomizers is that the atomizer is easily damaged. For example, if such an atomizer experiences a relatively small force, as may occur when the atomizer is dropped a few feet onto a hard factory floor, the atomizer can be easily damaged, requiring replacement or costly repair.

Another drawback of conventional aluminum rotary atomizers is that they are not easily cleanable during a changeover from spraying one form of liquid or paint to spraying another form of liquid or paint. For example, if such a conventional rotary atomizer is used in a typical factory environment to paint a first car blue and a next car red, the atomizer must be thoroughly cleaned between the time it paints the first car and the time it paints the second car. Atomizer cleaning is typically accomplished by running cleaning fluid through the atomizer to wash out residue from the first painting. Conventional rotary atomizers require a significant amount of cleaning fluid to accomplish this cleaning because the paint mist adheres to the aluminum surface of the atomizer. When paint adheres to the aluminum surface of a conventional rotary atomizer, the atomizer does not clean very easily. Another reason for this drawback of conventional rotary atomizers is that conventional rotary atomizers do not have a structure which optimally distributes cleaning fluid when passed therethrough during the cleaning process.

SUMMARY OF THE INVENTION

It is an object of the invention to address the aforementioned drawbacks. In one embodiment, the invention includes a sprayer, such as an electrostatic sprayer, and more particularly, a rotatable electrostatic sprayer, which is made from a material that is stronger than conventional sprayers, easier to clean than conventional sprayers, and imparts a greater percentage of an applied electrical charge to the resulting mist than that produced by conventional sprayers.

The invention also provides an atomizer bell for such an atomizing device, the structure thereof making the atomizer bell easier to clean, for example, during a changeover between colors, such that less cleaning fluid and less time is required to clean the atomizer.

It is another object of the invention to provide a device which has a structure which begins the atomization process before the liquid escapes the outer edge of the atomizer to more thoroughly atomize the liquid as it passes through the atomizing device.

BRIEF DESCRIPTION OF THE DRAWINGS

These and other objects and advantages of the invention will be apparent from the description herein in conjunction with the drawings, wherein.

DETAILED DESCRIPTION

Figure 1:
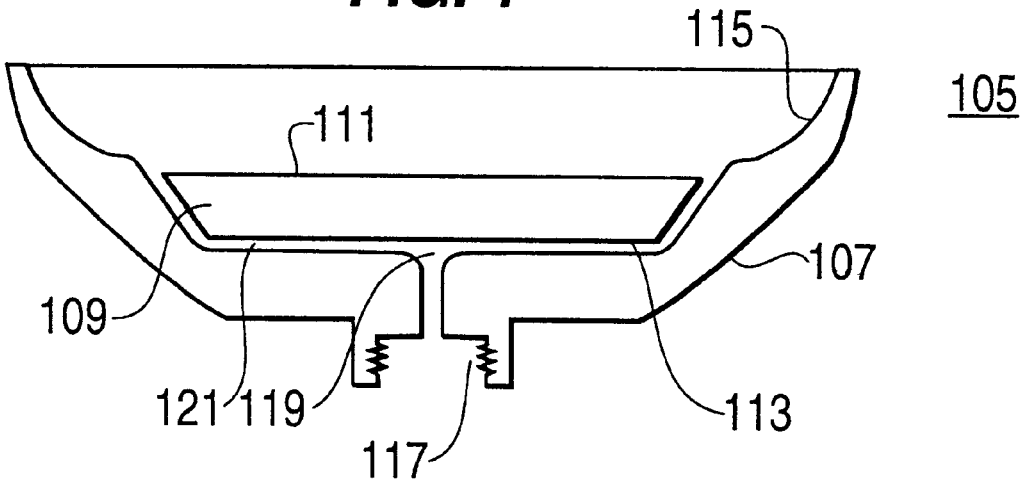
FIG. 1 shows a conventional rotary atomizer which can be modified to be made from a material in accordance with a first embodiment according to the invention.

Conventional sprayers, such as electrostatic sprayers, including rotatable, bell-shaped, electrostatic sprayers, are made of materials such as aluminum. FIG. 1 shows a cross-section of a conventional rotating atomizer bell. As shown therein, bell 105 has a bell-shaped member or base 107 and deflection part 109. Deflection part 109 has a front surface 111 and a rear surface 113. Base 107 has an overflow surface 115. Threads 117 of base 115 are provided to connect bell 105 to other portions of the atomizing device (not shown).

Base 107 contains opening 119 through which liquid passes onto rear surface 113 of deflection part 109. The liquid then passes through intermediate space or chamber 121 formed between deflection part 109 and base 107 and flows onto overflow surface 115 and the free bell space proximate thereto. As the liquid flows onto overflow surface 115, atomizer bell 105 is rotating at a rapid rate, such as 30,000 revolutions per minute. Centrifugal forces imparted upon the liquid by the rapidly rotating atomizer bell 105 cause conversion of the liquid into a mist. This process is known as the atomization process. In a conventional atomizer such as that shown in FIG. 1, an electrical charge is typically applied to the atomizing device of which the atomizer bell 105 is a part. The electrical charge applied to the atomizing device is also applied to bell 105 via the connection to the atomizing device provided by threads 117.

As described earlier, there are drawbacks inherent in the construction of bell 105 from aluminum. One drawback is that the aluminum surface of bell 105 can be easily damaged. For example, dropping bell 105 onto the factory floor can cause damage requiring costly repair or replacement. Other mishaps during manufacture, operation, or maintenance, can similarly cause damage to bell 105.

Another drawback is that although 100,000 volts of electric potential is applied to the atomizing device, tests show that the atomized mist proximate to the article, such as an automobile, only has a charge between 16,000 and 18,000 volts. Thus, a great amount of the applied voltage is dissipated. This drawback has tangible consequences, since the reduced charge on the atomized mist causes the atomized mist to be less attracted to the article being coated, and thereby requires the user to employ additional coating material during the coating process.

Finally, a conventional atomizing device made from aluminum is difficult to clean.

According to a first embodiment of the invention, a sprayer, such as atomizer bell 105, is made from a material comprised of carbon fiber, polytetrafluoroethylene (TEFLON) and polypropylene. Through experimentation, such a material has been found to be stronger than a conventional aluminum device easier to clean than a conventional aluminum device, and able to impart a greater percentage of an applied voltage to the atomized mist than that provided by a conventional aluminum device.

Optimally, the percentage of polypropylene in the material should be at least 30%, more preferably between 30% and 80%, further more preferably between 40% and 75%, and still more preferably between 50% and 70%. The TEFLON component of the material should be between 0.01% and 20%, preferably between 1% and 10%, still more preferably at least about 2%, and optimally between 3% and 7%. The carbon fiber component of the material should be at least 10%, preferably between 10% and 50%, more preferably between 20% and 40%, and still more preferably between 25% and 35%.

In one experiment, an atomizer bell according to the invention was constructed from a material comprising about 30% carbon fiber, about 5% TEFLON, and about 65% polypropylene. This atomizer bell was found to be more durable than a conventional aluminum atomizer bell, such that it was less susceptible to damage from being dropped on the floor or from other typical factory environment mishaps. This atomizer bell was also much easier to clean than a conventional aluminum atomizer bell. Further, this atomizer bell was found to impart a greater percentage of the applied voltage to the mist produced thereby, such that the voltage of the mist proximate to the article was found to be on the order of 20,000 volts.

When using an atomizer bell according to the invention, since the mist proximate to the article has a higher voltage, a greater percentage of the mist will adhere to the surface of the article. According to the aforementioned experiment, the article was placed between 16 and 20 inches from the atomizer bell, and more typically approximately 18 inches from the atomizer bell, and 100,000 volts were applied to each of a conventional aluminum atomizer bell and an atomizer bell according to the invention made from the aforementioned material. Whereas only 16% to 18% of the applied charge was found to be in the mist produced by the conventional aluminum atomizer bell, more than 20% of the applied charge was found to be in the mist produced by the device made from the material according to the invention. Specifically, when 100,000 volts were applied, the device according to the invention produced a mist with a charge of at least 20,000 volts proximate to the article. Since the mist produced by the device according to the invention has a greater charge, a greater percentage of the mist adheres to the surface of the article, and therefore a smaller amount of paint is required to coat the article. If utilized in a factory environment, the per unit savings of coating material can add up to a significant savings when calculated over a large number of coated articles.

Figure 2:
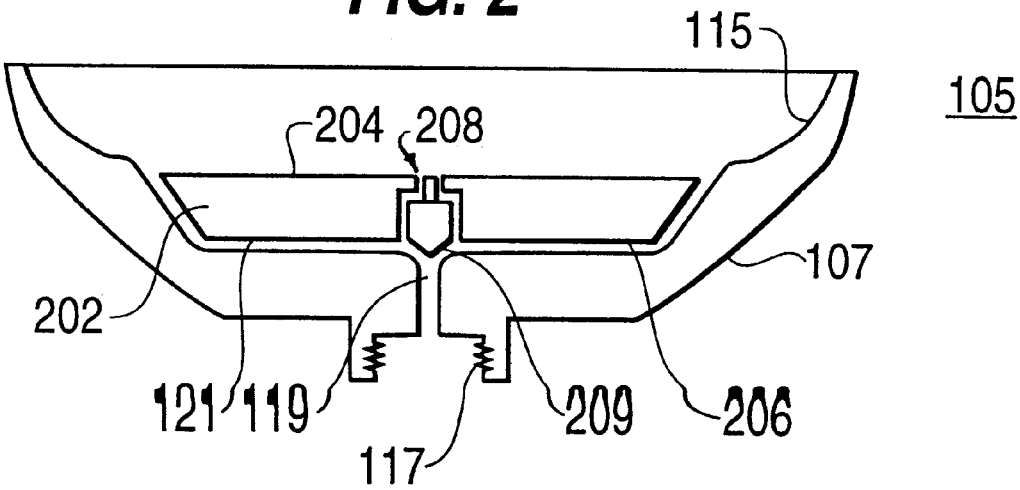
FIG. 2 shows an atomizer in accordance with a second embodiment according to the invention.
Figure 3:
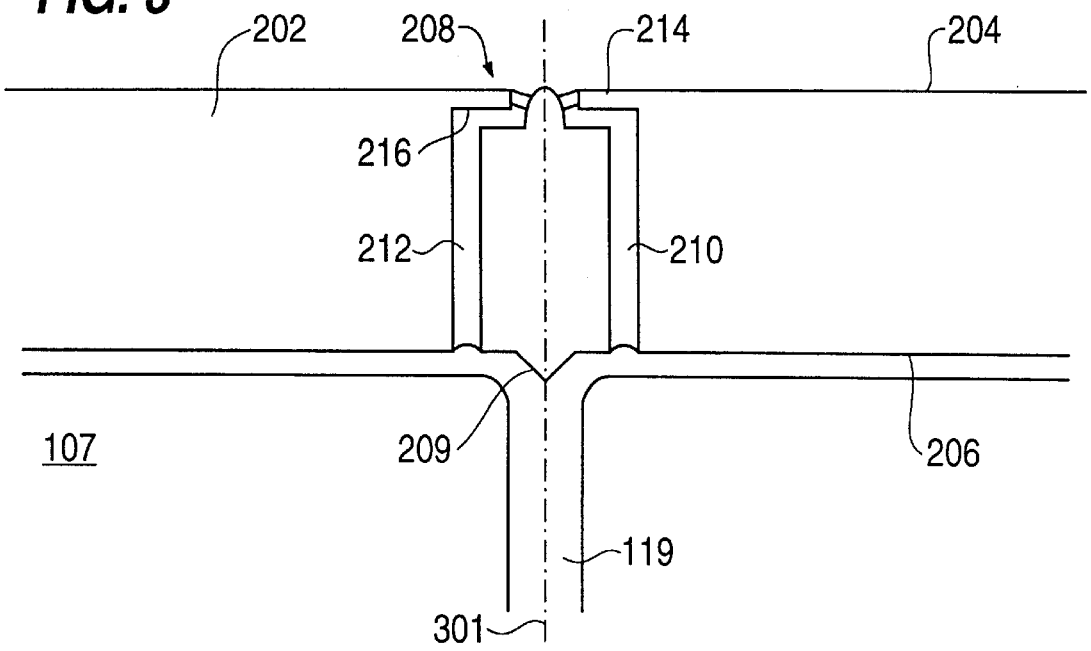
FIG. 3 shows one example of an atomizer according to the second embodiment.

FIG. 2 shows an example of a second embodiment of the invention which also allows for economies to be achieved by saving on material. Whereas the first embodiment allows less coating material, such as paint, to be used during the coating process, the embodiment of FIG. 2 allows less cleaning fluid to be used during the cleaning process. According to the embodiment of FIG. 2, deflection part 202 has a front surface 204 and a rear surface 206. In this second embodiment according to the invention, a center portion 208 of deflection part 202 is modified to allow the passage of cleaning fluid therethrough and onto front surface 204 during the cleaning process. As shown in greater detail in FIG. 3, deflection part 202 includes a pointed section 209 in the rear side of its center and opposite opening 119 of base part 107. A plurality of axial passages, such as 210 and 212, are positioned around pointed section 209 and extend toward front surface 204. FIG. 3 shows two axial passages. However, any number of axial passages may be provided. For example, a device with three axial passages has been found to be effective.

Figure 4:
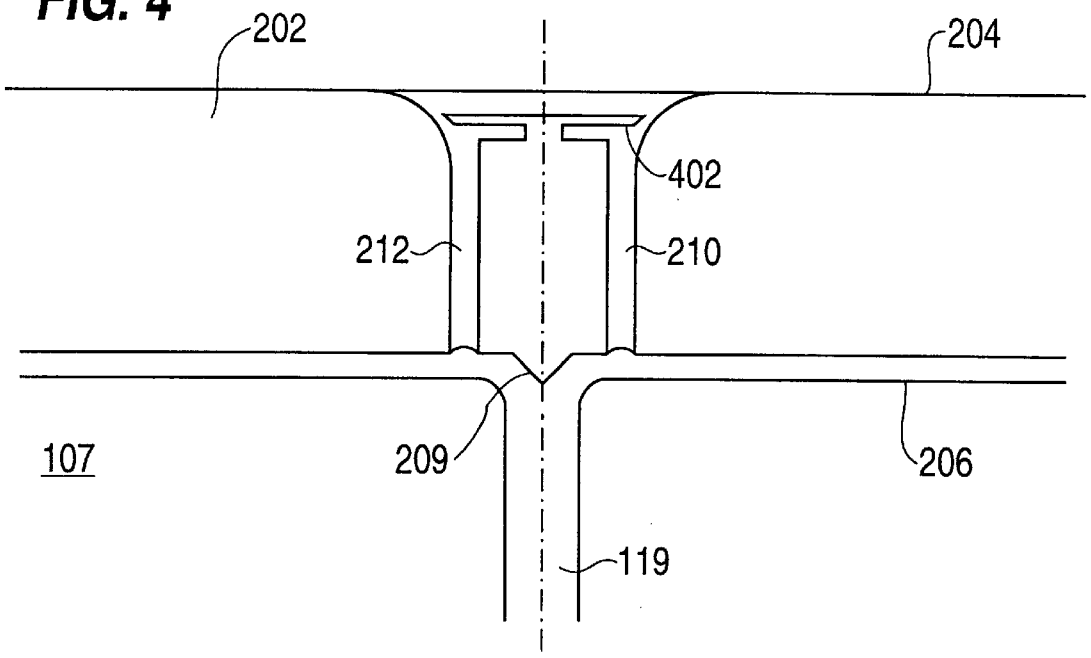
FIG. 4 shows a second example of an atomizer according to the second embodiment.

In the example of FIG. 3, deflection part 202 includes annular flange 214 positioned between axial passages 210 and 212 and front surface 204. Annular space 216 is therefore provided between flange 214 and axial passages 210 and 212. As shown, axial passages 210 and 212 are parallel with central axis 301. FIG. 4 shows an alternative embodiment wherein annular flange 402 is contiguous with a central portion of deflection part 202, whereas annular flange 214 in FIG. 3 is contiguous with an outer portion of deflection part 202.

In either of the embodiments of FIGS. 3 and 4, during cleaning operations, cleaning fluid flows through axial passages 210 and 212 and deflects off the annular flange (214 in FIG. 3, 402 in FIG. 4). The cleaning fluid then flows over front surface 204 toward overflow surface 115.

Figure 5:
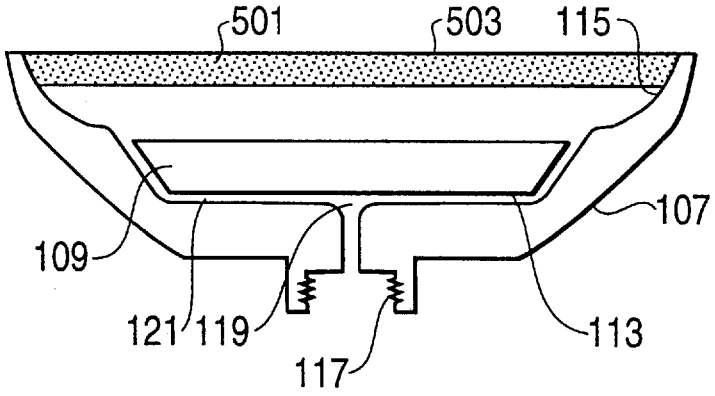
FIG. 5 shows an atomizer containing a plurality of pits according to a third embodiment according to the invention.

FIG. 5 shows a third embodiment according to the invention wherein atomizing bell 105 is provided with a plurality of pits 501 arranged near an outer edge 503.

Figure 6:
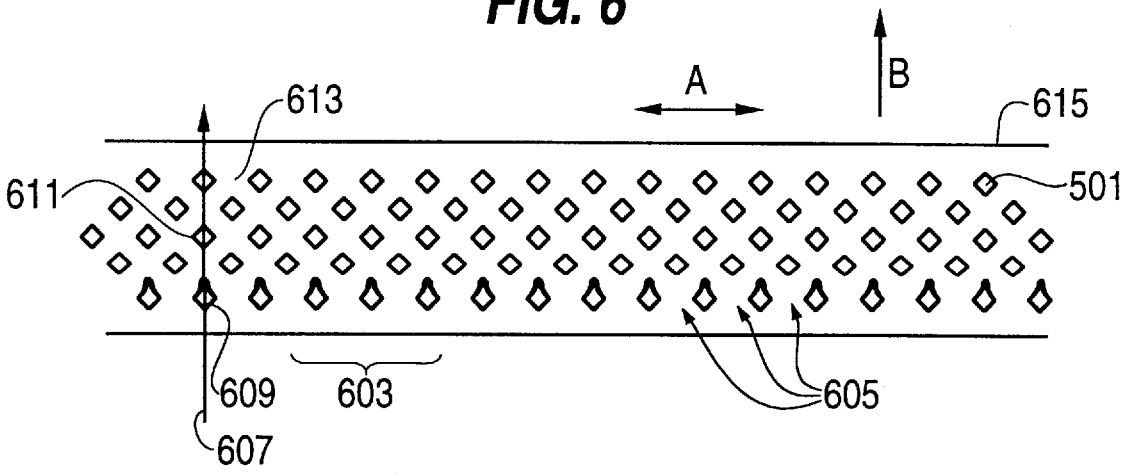
FIG. 6 shows the plurality of pits from FIG. 5 in greater detail.

As shown in more detail in FIG. 6, pits 501 can be arranged in a matrix pattern comprising a plurality of rows.

In the example of FIG. 6, the rows of pits 501 are offset (staggered). Spaces between pits 501 form two sets of surface lines. For example, surface lines 603 provide one set of substantially parallel surface lines, and surface lines 605 form a second set of substantially parallel surface lines. As shown, each surface line 603 intersects a plurality of surface lines 605. Pits 501 can be, for example, diamond shaped, and can have a depth of approximately one millimeter.

Arrow A shows the possible rotational directions of the atomizing device in FIG. 6. The centrifugal forces on the coating liquid caused by this rotation cause the coating liquid to flow in the direction of arrow B. It is believed that during atomization a portion of the liquid flows into and out of pits 501, the resulting turbulence imparted on the liquid by the liquid flowing into and out of pits 501 facilitating the atomization process. Path 607 shows an example of a possible flow path for a portion of the coating liquid. In this example, the portion of the liquid falls into and out of pits 609, 611 and 613. Turbulence caused by pits 609, 611 and 613 is likely to cause the portion of the liquid flowing therethrough to begin conversion into a mist before the liquid passes outer edge 615.

As shown in FIGS. 5 and 6, the embodiment of the invention incorporating pits 501 can be used with an otherwise conventional atomizing bell. Alternatively, a plurality of pits according to the third embodiment can be arranged at an outer edge of an atomizer containing the second embodiment of the invention shown in FIGS. 2–4. Further, the plurality of pits of the third embodiment can be incorporated into a sprayer according to the first embodiment of the invention which is made from the material described above.

While multiple embodiments according to the invention have been described, it will be appreciated that variants and modifications in the herein described invention, within the scope of the invention, will undoubtedly suggest themselves to those skilled in the art. Accordingly, the foregoing description should be taken as illustrative and not in a limiting sense.

What is claimed is:

1. A rotary atomizer for producing a mist from a liquid for application of the mist onto an article, the atomizer comprising:

a rotatable bell-shaped member having a first surface on which the liquid is adapted to flow, the first surface having a free end, the bell-shaped member having at least one passageway therein for introducing the liquid to the first surface, a plurality of rows of individual pits, each of which pits is a depression, arranged in a matrix pattern adjacent an outer edge of the first surface so that the liquid flows across the pits before the liquid is transformed into the mist.

2. An atomizer according to claim 1, wherein each of the pits is diamond shaped.

3. An atomizer according to claim 1, wherein the rows of pits are arranged substantially collinearly.

4. An atomizer according to claim 3, wherein the rows of pits are staggered so that spaces between the pits form two sets of uninterrupted surface lines, the surface lines of each set extending substantially parallel to each other and intersecting the surface lines of the other set.

5. An atomizer according to claim 6, wherein each of the pits is diamond shaped.

6. An atomizer according to claim 1, wherein the bell-shaped member is composed of a material comprising carbon fiber, polytetrafluoroethylene, and polypropylene.

7. An atomizer according to claim 6, wherein the polypropylene comprises at least about 30% of the material.

8. An atomizer according to claim 6, wherein the polytetrafluoroethylene comprises at least about 2% of the material.

9. An atomizer according to claim 6, wherein the carbon fiber comprises at least about 10% of the material.

10. An atomizer according to claim 6, wherein the material comprises:

between about 10% and about 50% carbon fiber;

between about 0.01% and about 20% polytetrafluoroethylene; and between about 40% and about 80% polypropylene.

11. An atomizer according to claim 6, wherein the material comprises:

between about 20% and about 40% carbon fiber;

between about 1% and about 10% poltetrafluoroethylene; and between about 30% and about 75% polypropylene.

12. An atomizer according to claim 6, wherein the material comprises:

between about 25% and about 35% carbon fiber;

between about 3% and about 7% polytetrafluoroethylene; and between about 50% and about 70% polypropylene.

13. An atomizer according to claim 6, wherein the material comprises about 30% carbon fiber, about 5% polytetrafluoroethylene, and about 65% polypropylene.

14. An atomizing device comprising:

a rotary atomizer bell adapted to rotate around a central axis, the bell having a bell-shaped member with a generally concave surface, a central deflection part concentric with the bell-shaped member, the deflection part having a front side that forms a part of the concave surface and a rear side facing a chamber, which communicates with an opening in the bell shaped member, a plurality of passageways communicating the chamber to the concave surface, the deflection part comprising:

a pointed section positioned centrally of the deflection part and extending in the rear side of the center of the deflection part opposite the opening; and a plurality of axial passages positioned around the pointed section, each passage being parallel to the central axis and extending toward a front surface of the deflection part.

15. An atomizing device according to claim 14, wherein the plurality of axial passages comprises at least three axial passages.

16. An atomizing device according to claim 14, wherein each of the axial passages is positioned such that a portion of the axial passage closest to the central axis is a distance from the central axis which is at least equal to a radius of the opening.

17. An atomizing device according to claim 14, wherein each of the axial passages is positioned such that a portion of the axial passage closest to the central axis is a distance from the central axis which is greater than a radius of the opening.

18. An atomizing device according to claim 16, wherein the deflection part includes a deflection flange opposite a front opening of each axial passage.

19. An atomizing device according to claim 18, wherein the deflection flange is contiguous with the front side of the deflection part.

20. An atomizing device according to claim 18, wherein the deflection flange is positioned between the front side and the back side of the deflection part.

21. An atomizing device according to claim 14, wherein the bell-shaped member has an overflow surface on the concave surface, a portion of the overflow surface having a plurality of pits.

22. An atomizing device according to claim 21, wherein the pits are arranged in a matrix pattern.

23. An atomizing device according to claim 22, wherein the matrix pattern comprises at least two concentrically arranged rows of pits.

24. An atomizing device according to claim 23, wherein the rows of pits are staggered such that spaces between the pits form two sets of uninterrupted surface lines, the surface lines of each set extending substantially parallel to each other and intersecting the surface lines of the other set.

25. An atomizing device according to claim 21, wherein each of the pits is diamond shaped.

26. An atomizing device according to claim 21, wherein at least the bell-shaped member is composed of a material comprising carbon fiber, polytetrafluoroethylene, and polypropylene.

27. An atomizing device according to claim 26, wherein the polypropylene comprises at least about 30% of the material.

28. An atomizing device according to claim 26, wherein the polytetrafluoroethylene comprises at least about 2% of the material.

29. An atomizing device according to claim 26, wherein the carbon fiber comprises at least about 10% of the material.

30. An atomizing device according to claim 26, wherein the material comprises:

between about 10% and about 50% carbon fiber;

between about 0.01% and about 20% polytetrafluoroethylene; and between about 40% and about 80% polypropylene.

31. An atomizing device according to claim 26, wherein the material comprises:

between about 20% and about 40% carbon fiber;

between about 1% and about 10% polytetrafluoroethylene; and between about 30% and about 75% polypropylene.

32. An atomizing device according to claim 26, wherein the material comprises:

between about 25% and about 35% carbon fiber;

between about 3% and about 7% polytetrafluoroethylene; and between about 50% and about 70% polypropylene.

33. An atomizing device according to claim 26, wherein the material comprises about 30% carbon fiber, about 5% poltetrafluoroethylene, and about 65% polypropylene.

34. A rotary atomizer for producing a mist from a liquid for application of the mist onto an article, the atomizer comprising:

a rotatable bell-shaped member having a generally concave surface on which the liquid is adapted to flow, the concave surface terminating at a peripheral free end, wherein a portion of the concave surface has a modified surface different from the rest of the concave surface;

a deflection part formed centrally of the bell-shaped member, the deflection part having a front side substantially contiguous with the concave surface and a rear side opposite the front side;

a chamber formed between the front side of the deflection part and bell-shaped member;

a plurality of passageways around the deflection part and communicating with the passageways for passage of the liquid to the concave surface from the chamber, wherein at least the bell-shaped member is composed of carbon fiber, polytetrafluoroethylene, and polypropylene.

35. A rotary atomizer according to claim 34, wherein the material comprises:

between about 10% and about 50% carbon fiber;

between about 0.01% and about 20% polytetrafluoroethylene; and between about 40% and about 80% polypropylene.

36. A rotary atomizer according to claim 34, wherein the material comprises:

between about 20% and about 40% carbon fiber;

between about 1% and about 10% polytetrafluoroethylene; and between about 30% and about 75% polypropylene.

* * * * *